United States Patent [19]

Iblings

[11] Patent Number: 4,513,484

[45] Date of Patent: Apr. 30, 1985

[54] SEAM CLOSURE DEVICE

[75] Inventor: Jackson R. Iblings, Encino, Calif.

[73] Assignee: Walter Allen Plummer, III, Tustin, Calif.

[21] Appl. No.: 560,497

[22] Filed: Dec. 12, 1983

[51] Int. Cl.[3] ..... A44B 19/00

[52] U.S. Cl. ..... 24/437; 24/418; 24/419

[58] Field of Search ..... 24/399, 400, 438, 587, 24/418, 419, 420, 437; 156/66; 428/57

[56] References Cited

U.S. PATENT DOCUMENTS

| | | | |
|---|---|---|---|
| 2,764,793 | 10/1956 | Sander | 24/428 |
| 2,810,944 | 10/1957 | Sander | 24/400 |
| 3,153,269 | 10/1964 | Berry | 24/427 X |
| 3,234,614 | 2/1966 | Plummer | 24/400 |
| 3,404,437 | 10/1968 | Plummer | 29/270 |
| 3,478,404 | 11/1969 | Plummer | 24/399 X |
| 3,572,191 | 3/1971 | Bannies | 24/399 X |
| 3,808,665 | 5/1974 | Bannies | 29/243.5 |
| 3,858,282 | 1/1975 | Plummer | 24/576 |
| 4,388,747 | 6/1983 | Plummer | 24/535 |

*Primary Examiner*—Henry F. Epstein
*Attorney, Agent, or Firm*—Sellers and Brace

[57] ABSTRACT

Disclosed is a device for closing a snaplock type seam having a pair of internestable interlocking V-shaped portions. The one piece closure device is assembled astride the V-shaped portions of the two seam members and functions to force these portions laterally into interlocked assembly as the device is advanced along the seam.

18 Claims, 3 Drawing Figures

SEAM CLOSURE DEVICE

This invention relates to interlockable seam members, and more particularly to a unique closure device for progressively closing the seam as the device is pulled therealong.

BACKGROUND OF THE INVENTION

A great variety of internestable interlockable seams have been proposed including, in particular, seams extruded from elastomeric material and formed with cooperating interlockable grooves. Some of these can be closed by the application of finger pressure when the parts are placed in juxtaposition whereas the closure of others is greatly expedited by an appropriately designed closure device as it is advanced along the seam members. Various designs for such devices each specially designed for use with a particular seam construction are disclosed in the following U.S. Pat. Nos., namely Sander 2,764,793 and 2,810,944; Berry 3,153,269; Plummer 3,234,614, 3,404,437, 3,478,404; and Bannies 3,572,191, 3,808,665. These several constructions have been commercialized and have served their intended purposes of closing a continuous separable seam of the particular type for which each of these devices was designed. However, no one of these prior constructions is useful in closing a snaplock seam having laterally facing internestable interlockable V-shaped portions extending therealong.

SUMMARY OF THE INVENTION

The unique closure device for a snaplock type seam formed from extruded elastomeric material comprises a pair of fingergrip members hingedly connected at one end which end is provided with a pair of hooks or jaws facing toward one another from the opposite sides of the hinge. These jaws are adapted to be placed astride the V-shaped components of a snaplock seam with one jaw engaging the interior apex of one seam member and the other engaging the exterior apex of the other seam member. The closure of the fingergrip members moves the two hooks toward one another and into a position thereby forcing the adjacent V-shaped portions of the seam members into their interlocked closed position. While so held, the closure device is advanced along the seam thereby progressively closing and interlocking the two seam members together.

Accordingly, it is a primary object of this invention to provide a simply constructed closure device for a snaplock type seam operable to progressively interlock the V-shaped portions thereof as the device is pulled therealong.

Another object of the invention is the provision of a one piece seam closure device formed by a pair of fingergrip members hingedly connected at one end and equipped with jaws respectively engageable with the interior apex of one seam member and with the exterior apex of the companion seam member thereby to interlock the two seam members.

Another object of the invention is the provision of a seam closure device molded in one piece from high strength plastic material and having a pair of fingergrip members pivotally interconnected by a live hinge.

These and other more specific objects will appear upon reading the following specification and claims and upon considering in connection therewith the attached drawing to which they relate.

Referring now to the drawing in which a preferred embodiment of the invention is illustrated.

Figure 1:
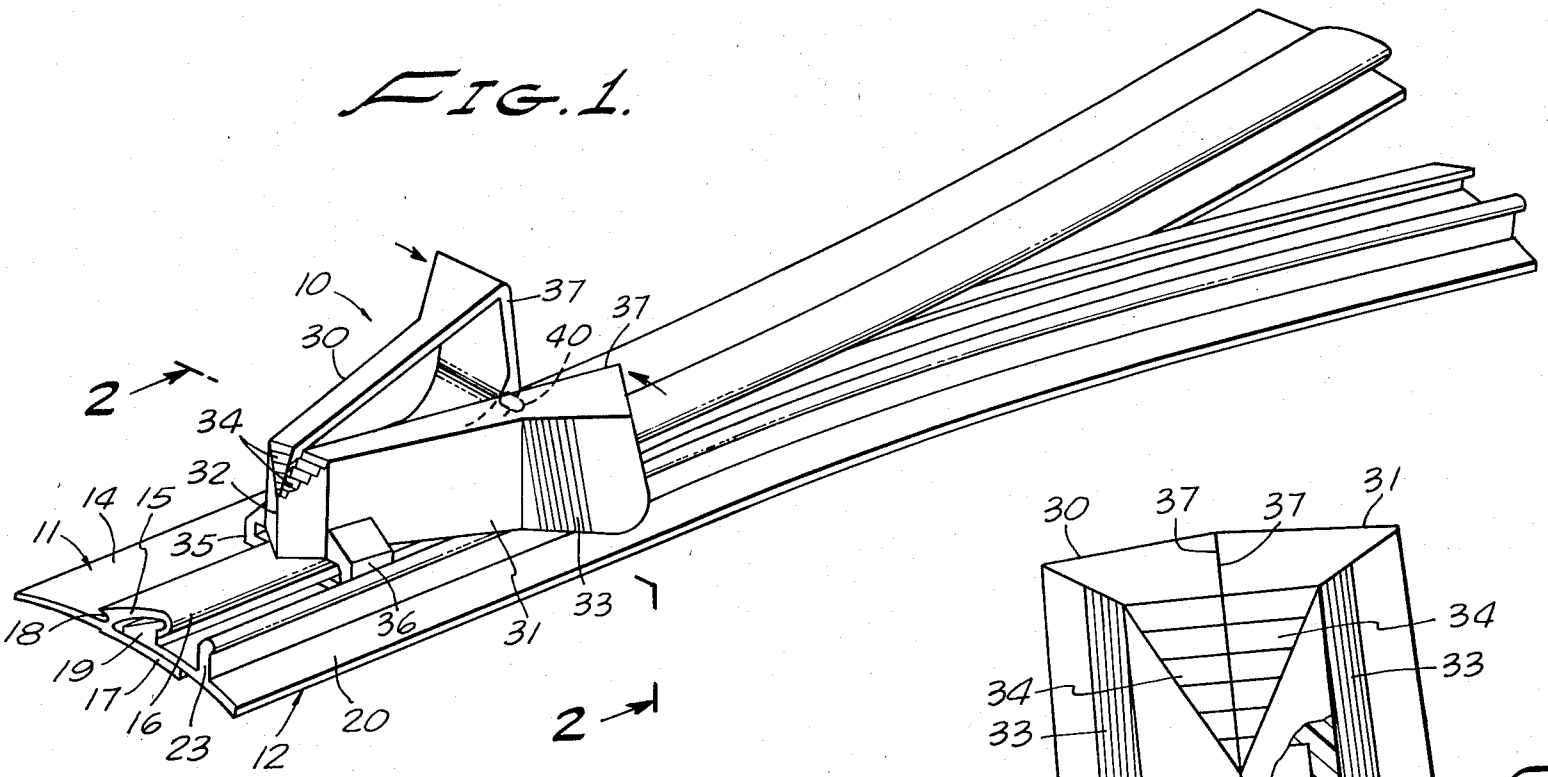
FIG. 1 is a perspective view showing an illustrative embodiment of the seam closure device assembled astride a snaplock seam with the fingergrips in open position.
Figure 2:
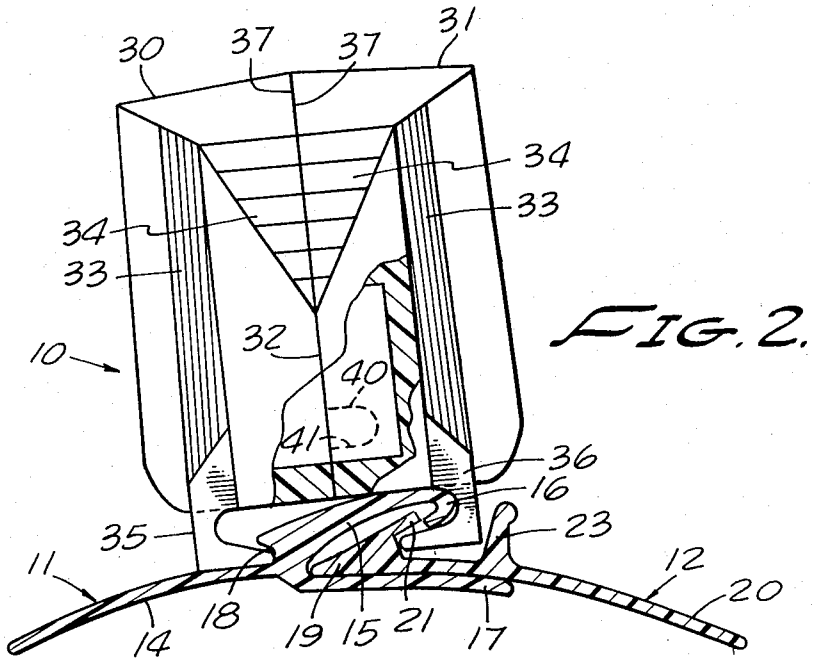
FIG. 2 is a cross sectional view on an enlarged scale taken along line 2—2 on FIG. 1 but showing the closure device in closed position and with a portion of the hinged end of the device broken away to show the structural details.
Figure 3:
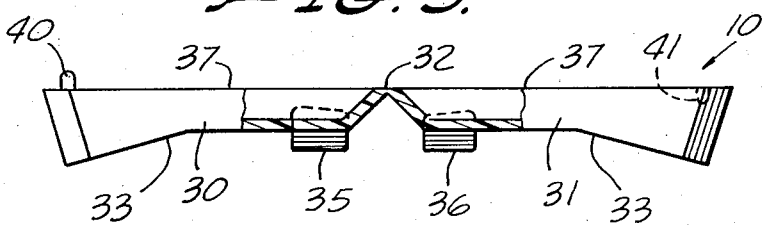
FIG. 3 is a top plan view of the closure device in the fully opened position upon removal from its manufacturing mold.

Referring to FIGS. 1 to 3, there is shown an illustrative embodiment of the seam closure device, designated generally 10, in an initial assembly position on a snaplock seam adapted to be closed thereby and comprising a pair of elongated seam members 11 and 12. These seam members are extruded from flexible but relatively high durometer elastomeric material. Seam members 11 and 12 have a cross sectional contour best shown in FIGS . 1 and 2 and a durometer preferably ranging between D 50 and D 65. Seam member 11 has a wide mounting flange 14 along one lateral edge adapted to be suitably secured to an article having an opening to be closed by the seam members. The opposite edge of the seam member is provided with a laterally facing V-shaped female portion one leg 15 of which is formed with a deep hook 16 extending inwardly and toward its interior apex and a second leg 17 which preferably extends laterally outwardly beyond hook 16 to provide a support and glide surface facilitating the entrance of the adjacent lateral edge of the second seam member 12. The exterior apex of the female portion of the seam member is provided with a continuous groove 18 the purpose of which will become apparent presently.

The second seam member 12 is also provided with a V-shaped male portion 19 along the left hand lateral edge of its mounting member 20. The male portion 19 is of smaller cross section than the female portion 15 and the free rim edge of its outer leg 21 is positioned for seating engagement within hook 16 in the fully assembled position of the snaplock seam members shown in FIG. 2. Seam member 12 may also be provided with a low height rib or flange 23 projecting outwardly from the exterior surface thereof and extending lengthwise of the seam member in an area spaced laterally from the male portion 19. This rib or flange is useful in starting the initial assembly of one end of the seam to facilitate the attachment of the closure device 10 to the seam.

Referring to FIG. 3, closure device 10 is shown as comprising a unitary one-piece structure after its removal from a mold. The device comprises a pair of elongated fingergrip members 30, 31 pivotally connected by a live hinge 32. The hollow fingergrip members are formed of any suitable high strength plastic material, such a polypropylene or the like, suitable for providing a live hinge of long service life. The remotely spaced outer surfaces at one end preferably flare outwardly away from one another and away from hinge 32 and are suitably roughened as molded to provide firm gripping ribs 33 engageable by the thumb and forefinger of an operator while advancing the closure device along the seam to close it. The upper rear corner of members 30, 31 is molded with finger seating ribs and grooves 34 found useful in supplementing the gripping ribs 33 in advancing closure device 10 along a seam.

Slightly forwardly of hinge 32 the fingergrip members are provided with an L-shaped hook 35, 36 facing one another along the underside of their respective fingergrip members. When the fingergrip members 30, 31 are in closed position with their inner edges 37 lying flush against one another as shown in FIG. 2, the free end of hook 35 is seatable in the groove 18 along the exterior apex of the female portion 15 of the seam 14 and the free end of hook 36 is seatable against the interior apex of the male portion 19 of seam member 12. In these positions, the two hooks are effective to advance the female and male portions 15 and 19 into their maximum overlapped positions with the apex of the male member socketed snugly against the interior apex of the female member. At that time, the free rim edge 21 of the male member has snapped past the free inner end of hook 16. After the closure device has been advanced slightly farther along the seam members, assembled upstream portions become relaxed and the free rim edge 21 of male member 19 becomes fully seated and interlocked within hook 16 to hold the two seam members positively assembled with one another.

Closure device 10 is preferably provided with means to hold the two fingergrip members closed against one another until deliberately assembled as otherwise the memory of the live hinge urges these members apart. Suitable means for this purpose comprises a detent post 40 (FIG. 1) positioned to have a slight interference fit within a shallow well 41 in the adjacent edge of the other member 31.

In use the operator inserts one end of the male member 19 into the cavity of the female member 15 using finger pressure applied against the rib 23 of the male member and the edge of groove 18 along the apex of female member 15. The inner leg 17 of the female member serves as a guide and a camming surface to pilot the male and female portions 15 and 19 together. The outer upper surface of the male member 19 engages hook 16 of the female member and deflects it outwardly. When the seam members are positioned as shown in FIG. 2, hook 16 resumes its normal unstressed condition in readiness to interlock with the edge of leg 21 as soon as the closure device is advanced a short distance. While the seam members are held in this position the closure device 10 is placed astride the exterior of the V-shaped portions of the two seam members. The closure device 10 is then placed astride the male and female portions 15 and 19 while the two fingergrip members 30, 31 are partially open with their respective hooks 35, 36 spaced apart. Hook 36 is then inserted past hook 16 and into contact with the interior apex of male member 19. When so positioned device 10 is rotated through a small arc counterclockwise as viewed in FIG. 2 to seat the end of hook 35 in groove 18 at the exterior apex of the female portion 15 as the two fingergrip members are closed against one another. As this takes place, detent 40 seats in recess 41 and is effective to hold the fingergrip members closed as shown in FIG. 2.

The operator now proceeds to close the seam by grasping the fingergrip member surfaces 33 between the thumb and forefinger and pulls the device lengthwise of the seam until its full length has been closed. Additionally or alternatively, the user may seat the tip of the index finger against ribs 34 at the rear or trailing end of the device while gripping the forward ends of the fingergrip members between the thumb and the foremost finger to facilitate the advance of the closure device along the seam.

While the particular seam closure device herein shown and disclosed in detail in fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A seam closure device for progressively closing a pair of seam members each having a V-shaped portion extending lengthwise thereof sized and shaped for internesting assembly as one of said V-shaped portions seats behind an inturned hook on one leg of the other one of said V-shaped portions, said closure device comprising:

a pair of elongated finger grip members pivotally interconnected at one end;

hook-like means facing toward one another from a respective one of the finger grip members adjacent said one end thereof and constructed to straddle the V-shaped portions of said seam members from one side thereof with one of said hook-like means seated against the interior apex of the smaller V-shaped portion and the other of said hook-like means seated against the exterior apex of the larger V-shaped portion; and said finger grip members being pivotable toward one another and thereby operable to force said V-shaped portions progressively into internested assembly as said device is advanced along said seam members.

2. A seam closure member as defined in claim 1 characterized in the provision of means normally urging said finger grip members pivoted apart with said hook like means spaced apart and in readiness for assembly to seam members to be internested.

3. A seam closure member as defined in claim 1 characterized in that said device is molded in one piece from elastomeric material with a live hinge pivotally interconnecting said one end thereof.

4. A seam closure device as defined in claim 1 characterized in that the remotely spaced faces of the end of said finger grip members remote from said one end flare outwardly away from one another.

5. A seam closure device as defined in claim 2 characterized in the provision of means for retaining said finger grip members in closed position until deliberately released.

6. A seam closure device as defined in claim 1 characterized in that the same is molded in one piece from polypropylene.

7. A seam closure device as defined in claim 1 characterized in that said elongated finger grip members are channel shaped transversely thereof.

8. A seam closure device as defined in claim 1 characterized in that said hook like means are integral with the outer faces of said finger grip members adjacent one end of said pivotal interconnection therebetween whereby said finger grip members are positioned closely beside and exteriorly of a pair of seam members while said closure device is assembled thereto for the internesting assembly of said seam members.

9. A seam closure device as defined in claim 1 characterized in the provision of a finger tip seating roughened surfaces crosswise of the hinged end of said device useful in advancing said device along said seam members.

10. A seam closure device as defined in claim 1 characterized in that the pivotally interconnected end of said finger grip members are provided with a finger tip engaging surface extending transversely of finger grip members on the side thereof remote from said hook-like means.

11. A seam closure device as defined in claim 10 characterized in that said finger tip engaging surface is irregularly contoured to prevent slippage of the operator's finger when firmly pressed thereagainst.

12. A seam closure device as defined in claim 1 characterized in that the free ends of said hook-like means respectively sealable against the interior and exterior V-shaped portions of said seam members diverge away from one another at an acute angle and toward the ends of said finger grip members remote from the pivotally interconnected end thereof.

13. A seam closure device for progressively closing a pair of interlockable seam members while confined to one side of said seam members, said seam members being of the type having portions shaped to interlock with one another when progressively internested by movement toward one another generally in the plane of and adjacent one side of said seam members, said closure device comprising:

a pair of elongated members pivotally interconnected at one end of hinging movement toward and away from one another about an axis generally normal to the place of said seem;

said pair of members each having a portion shaped and operable when positioned astride one side of said seam members to engage a longitudinally extending portion of a respective one of said seam members and to force said seam members progressively into interlocked assembly as said closure device is advanced along said seam members while said elongated grip members are held pivoted toward one another.

14. A seam closure member as defined in claim 13 characterized in that said device is molded in one piece from elastomeric material with a live hinge pivotally interconnecting said one end thereof.

15. A seam closure device as defined in claim 13 characterized in the provision of means for retaining said pair of members in closed position until deliberately released.

16. A seam closure device as defined in claim 13 characterized in the provision of means for retaining said elongated members in closed position until deliberately released.

17. A seam closure device as defined in claim 13 characterized in that the same is molded in one piece from polypropylene.

18. A seam closure device as defined in claim 13 characterized in the provision of a finger-tip-seating roughened surfaces crosswise of the hinged end of said device useful in advancing said device along said seam members.

* * * * *